US005538285A

United States Patent [19]

Goode

[11] Patent Number: 5,538,285

[45] Date of Patent: Jul. 23, 1996

[54] SKI POLE SHAFT WITH ROTATING WING FOIL

[76] Inventor: David P. Goode, 1997 Long Lake Shore Dr., Bloomfield Hills, Mich. 48302

[21] Appl. No.: 183,159

[22] Filed: Jan. 18, 1994

[51] Int. Cl.[6] ..... A63C 11/22

[52] U.S. Cl. ..... 280/819; 135/66; 244/130; 280/821

[58] Field of Search ..... 280/819–824, 280/809, 810, 813, 826, 281.1; 244/130, 39; 273/81.3, 81 C; 135/84, 80, 76, 66, 33.2

[56] References Cited

U.S. PATENT DOCUMENTS

| | | | |
|---|---|---|---|
| 126,437 | 1/1872 | Gray | 244/130 |
| 1,408,868 | 3/1922 | Dutcher | 244/130 |
| 2,397,957 | 4/1946 | Freeman | 244/130 |
| 4,744,584 | 5/1988 | Monreal | 280/606 |
| 4,756,555 | 7/1988 | Bachmann | 280/819 |
| 4,890,861 | 1/1990 | Bachmann | 280/810 |
| 4,921,275 | 5/1990 | Santanen et al. | 280/824 |
| 5,203,589 | 4/1993 | Tio | 280/821 |

FOREIGN PATENT DOCUMENTS

| | | | |
|---|---|---|---|
| 2030246 | 5/1992 | Canada | 280/819 |
| 0509683 | 9/1930 | Germany | 280/809 |
| 2613580 | 10/1977 | Germany | 280/821 |
| 2224253 | 5/1990 | United Kingdom | 280/281.1 |
| 2231316 | 11/1990 | United Kingdom | 244/130 |
| 93011839 | 6/1993 | WIPO | 280/819 |

*Primary Examiner*—Anne Marie Boehler
*Attorney, Agent, or Firm*—Young & Basile

[57] ABSTRACT

A device for reducing wind resistance or drag on a ski pole shaft comprising a wing foil device rotatably mounted over a significant portion of a cylindrical ski pole shaft for self-aligning rotation about the shaft axis. In one embodiment the wing foil device is an essentially hollow, thin-walled element having a rounded internal bearing surface at its leading edge which rotates on the surface of the shaft. An internal wall or rib structure maintains the primary internal bearing surface against the ski pole shaft and prevents lateral movement or rattle. In a preferred embodiment the top and bottom edges of the wing foil device are angled to be parallel with air flow when the poles are held at a predetermined angle while skiing.

7 Claims, 1 Drawing Sheet

SKI POLE SHAFT WITH ROTATING WING FOIL

FIELD OF THE INVENTION

The present invention is related to ski pole shaft structure which reduces the wind-resistance of the shaft.

BACKGROUND OF THE INVENTION

With continuing improvements in skis and the resulting increase and interest in high speed skiing, for example in competitive racing events, the wind resistance of the skier's poles has become an increasingly important factor.

U.S. Pat. No. 5,265,911, addresses the problem of significant wind resistance during high speed skiing with a novel ski pole shaft of significantly reduced diameter yet retaining a high tensile strength. This approach to reducing the wind resistance of the ski poles has been very effective.

However, there are conditions under which it is desirable to use a relatively thick ski pole shaft. It is also generally desirable to reduce the wind resistance of poles without reducing their diameter and their corresponding strength.

SUMMARY OF THE INVENTION

My invention significantly reduces the wind resistance of any ski pole shaft to which it is applied, regardless of diameter or cross section. In general this is accomplished by placing a rotatable, wing foil-shaped device over a significant portion of the ski pole shaft. The aerodynamic effect of the wing foil-shape device substantially reduces wind resistance over the portion of the ski pole shaft which it covers.

The rotating nature of the invention relative to the direction of travel of the ski pole shaft (or the direction of travel of the skier) prevents undesirable planing and loss of control of the shaft as the skier changes direction. The rotating wing foil aligns itself with the direction of travel of the skier. In this manner the wind resistance is reduced and control over the shaft is maintained.

In a preferred embodiment of the invention the foil comprises a substantially teardrop-shaped, hollow, thin-walled device mounted to rotate relative to the ski pole shaft. The wing foil device has a rounded leading edge rotating around the shaft and symmetrical side surfaces ending in a point or trailing edge spaced from the ski pole shaft. In a further embodiment the wing foil contains an inner wall or rib structure which rotationally conforms to the ski pole shaft to prevent lateral movement of the foil relative to the shaft.

In an alternate embodiment the wing foil device is fixed to the ski pole shaft, and the shaft rotates relative to the ski pole grip as the skier changes direction.

In a further embodiment the top and bottom edges of the foil are angled to be parallel to the wind direction when the poles are held at an angle.

These and other advantages of the invention will become apparent upon further reading of the specification.

DETAILED DESCRIPTION OF THE DRAWINGS

Figure 1:
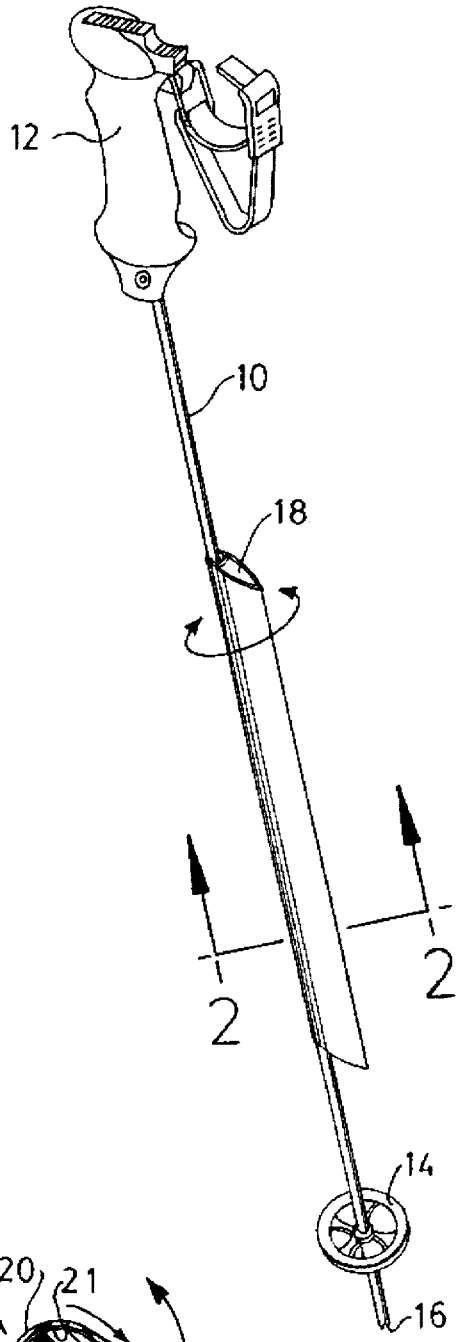
FIG. 1 is a perspective view of a ski pole shaft employing the wind-reducing wing foil of the present invention.

Referring now to FIG. 1, a conventional cylindrical ski pole shaft 10 is shown having a grip 12 on its upper end and a basket 14 on its lower end. Tip 16 can be secured to the pole in known manner.

Regardless of the diameter of ski pole shaft 10, its cylindrical shape results in at least some wind resistance and turbulence as air flows over its surface during skiing, particularly during high speed skiing. At high speeds the wind resistance gives an unwelcome feeling of weight or drag to the poles, and in competitive, high speed skiing events can perceptibly slow a skier.

To substantially reduce the wind resistance, drag and turbulence on ski pole shaft 10, a wing foil device 18 is mounted over a substantial portion of shaft 10. Foil 18 is generally teardrop- or wing-shaped in cross section, and in accordance with known aerodynamic principles greatly reduces the wind resistance or drag on the portion of shaft 10 which it covers. Foil device 18 has a rounded leading edge 20 with a diameter approximating that of shaft 10, and side surfaces 22 extending rearwardly and meeting at a trailing edge 23 spaced from the pole shaft.

In the illustrated embodiment, wing foil device 18 is preferably a hollow, thin-walled, lightweight structure integrally molded from an ABS plastic. It will be apparent to those skilled in the art, however, that foil device 18 may be formed from a variety of materials, including for example other polymers or lightweight metals.

The wing foil device 18 of the present invention operates most efficiently when it is aligned parallel to the direction of travel of the skier and ski pole through the air; i.e., when the center of leading edge 20 is headed directly into the wind along the line of symmetry of wing foil 18. In this case the air flows evenly over and around the surface of wing foil 18 from front to back, without any side-to-side forces generated by the air flow which would tend to make the pole "plane" or waver back and forth.

Since it is inevitable that the skier will rotate the poles relative to the direction of travel through the air while skiing, the wing foil device of the present invention is rotatably mounted on shaft 10 so that it remains aligned with the direction of travel of the skier and pole. When the skier rotates the pole shaft or changes direction, the force of the air moving over both sides of the ski pole shaft forces the freely pivoting wing foil 18 into proper alignment with the direction of travel. In this manner the airflow forces on either side of wing foil 18 are kept equal, eliminating any tendency of the ski pole to "plane" or fly around in an uncontrolled manner.

An additional feature of the wing foil device 18 is the large, relatively flat side surface which provides a convenient, easily-read surface for a logo or design graphics **18*a*. Logos and designs are more easily applied on the wide wing surfaces than on the shaft surface, can be made larger, and have less distortion due to curvature. Moreover, the wing foil 18 can be removed from the shaft, for example where the grip 12 or basket 14 is removable, and replaced with a new device 18 of a different size or with different graphics 18*a***.

Figure 2:
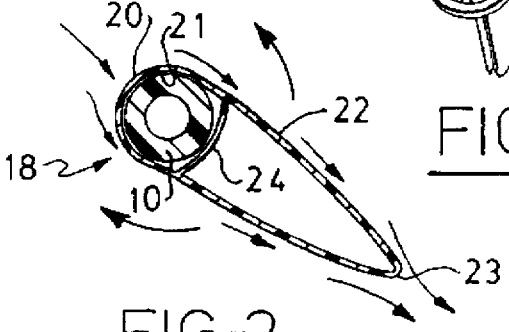
FIG. 2 is an end sectional view of the ski pole shaft and foil of FIG. 1.

Referring now to FIG. 2, the ski pole shaft 10 and wing foil device 18 of the present invention are shown in end view. In the illustrated embodiment the diameter of ski pole shaft 10 is approximately 0.44 inches, the length of foil device 18 along its line of symmetry from leading edge 20 to the junction of side surfaces 22 is approximately 1.44 inches, and the radius of curvature of the side surfaces is approximately 6.85 inches. Wing foil 18 in FIG. 2 is a hollow, thin-walled, unitary molded structure. The essentially semi-circular leading edge 20 defines a semi-cylindrical inner bushing or bearing surface 21 bearing against pole shaft 10. The outer surface of pole shaft 10 and the inner bearing surface 21 of wing foil 18 are smooth, allowing the wing foil to freely pivot or rotate about the longitudinal axis of shaft 10.

An internal transverse wall or rib 24 extending between sides 22 contacts at least a tangential portion of shaft 10 to hold inner bearing surface 21 against the surface of shaft 10 and prevent lateral or angular movement of the wing foil device-relative to the longitudinal axis of shaft 10. In the illustrated embodiment transverse rib 24 extends along the entire length of wing foil 18. However, transverse rib 24 can extend along only a portion of wing foil 18, or could comprise a plurality of short ribs spaced longitudinally along wing foil 18. In the illustrated embodiment, rib 24 is slightly curved over at least a portion thereof to match the curvature of shaft 10. However, a straight-walled transverse rib in tangential contact with the surface of shaft 10 can also be used.

Figure 3:
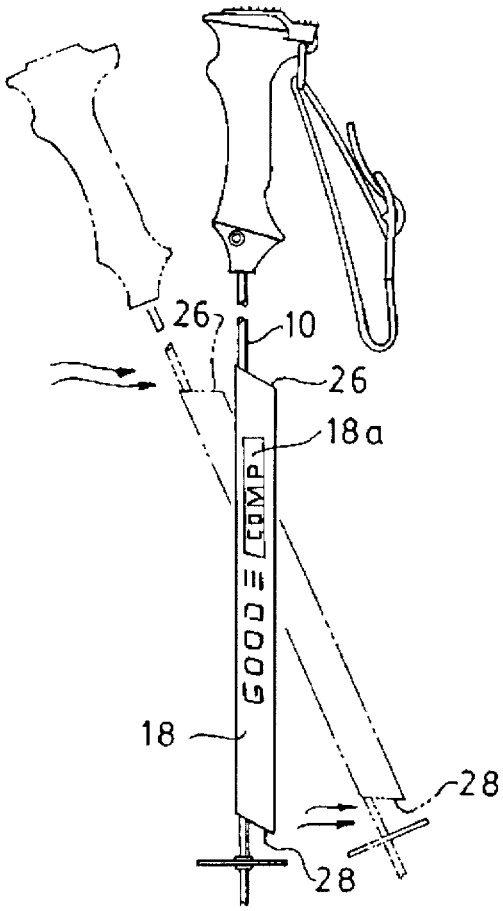
FIG. 3 is a side view of the wing foil device of FIGS. 1 and 2 with the shaft in vertical and angled positions.

Referring now to FIG. 3, the wing foil 18 of FIGS. 1 and 2 is shown in side view to illustrate a preferred angular orientation of top and bottom edges 26,28. Frequently during skiing, and particularly during high speed skiing, the ski poles are held at a rearwardly-pointing angle rather than perpendicular to the air flow past the skier. To reduce turbulence and drag at the top and bottom edges 26,28 of wing foil 18, they are cut or beveled at an angle anticipated to maintain them essentially parallel to the flow of air over the wing foil 18 when the ski pole is held at a rearwardly-pointing angle. For example, if the poles are anticipated as being angled rearwardly from the vertical between 20°–40° during skiing, the top and bottom edges 26,28 of wing foil 18 can be cut or angled downwardly, for example, at a 30° angle from the perpendicular to the longitudinal axis of the ski pole shaft. Accordingly, when the ski poles are angled rearwardly between 20°–40 ° during skiing, top and bottom edges 26,28 are essentially parallel to the flow of air past the skier and the poles and do not create any significant drag or turbulence.

It will be understood that the angle of top and bottom edges 26,28, relative to the longitudinal axis of wing foil 18 can vary according to the intended use of the pole and the anticipated angle at which the pole will principally be used. For low-speed, recreational skiing, the angle of top and bottom edges 26,28 from the perpendicular may be relatively shallow; for extreme high speed skiing conditions the angle from the perpendicular may be relatively steep.

Figure 4:
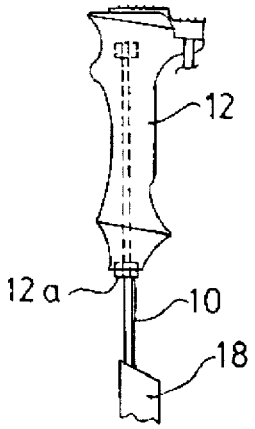
FIG. 4 is a side view of an alternate embodiment of the wing foil invention.

Referring now to FIG. 4, an alternate embodiment of the invention is illustrated in which the wing foil 18 is fixed to the ski pole shaft, for example by molding, mechanical or adhesive bonding, or other suitable methods. In FIG. 4, the wing foil does not rotate relative to the ski pole shaft 10. To eliminate the tendency of the shaft and the fixed wing foil 18 to plane or waver back and forth when the skier changes direction or rotates the ski pole in his hand, grip 12 is attached to the upper end of shaft 10 by a rotating bearing 12*a*. Bearing 12*a* allows the ski pole shaft to rotate freely relative to the grip. Accordingly, when the skier changes direction, or rotates the grip relative to the direction of travel and airflow past the skier, the ski pole shaft and fixed wing foil 18 freely rotate to remain properly aligned with airflow and to prevent planing.

It will be understood from the foregoing description of an illustrated example that the invention may take different embodiments, and should not be limited except as set forth in the appended claims.

I claim:

1. In combination with a ski pole having a longitudinal shaft, an apparatus for reducing the wind resistance or drag of at least a portion of the ski pole shaft, comprising:

a wing foil device rotatably mounted on the ski pole shaft, the wing foil device comprising a substantially hollow, wing-shaped device having a longitudinal shaft-receiving bore, a rounded leading edge defining an inner pole bearing surface, integral side walls extending from the leading edge to a trailing edge spaced radially from the shaft, and internal rib means extending between the side walls, the foil device being mounted over a substantial portion of the ski pole shaft for rotation relative to the shaft with the inner bearing surface and internal rib means in sliding contact with the ski pole shaft.

2. Apparatus as defined in claim 1, wherein the wing foil device includes an internal transverse rib means at least tangentially contacting the ski pole shaft when the shaft is in contact with the inner bearing surface.

3. Apparatus as defined in claim 2, wherein the rib means comprise a curved rib extending between the symmetrical side surfaces of the wing foil device such that a portion of the rib means is in sliding contact with the ski pole shaft.

4. Apparatus as defined in claim 1, wherein the wing foil device includes top and bottom edges extending radially from the ski pole shaft, the top and bottom edges angled relative to the Ski pole shaft such that the top and bottom edges are essentially parallel to the direction of air flow past the shaft when the shaft is held at a predetermined rearwardly-pointing angle.

5. Apparatus, as defined in claim 4, wherein the top and bottom edges are parallel to one another.

6. An apparatus for reducing the wind resistance or drag of at least a portion of a ski pole having a longitudinal shaft, the apparatus comprising:

a substantially hollow, wing-shaped foil device having a longitudinal pole-receiving bore, a rounded leading edge defining an inner pole bearing surface, integral side walls extending from the leading edge to a trailing edge spaced radially from the bearing axis of the inner bearing surface, and internal rib means extending between the side walls, the foil device mounted over a substantial portion of the ski pole shaft for rotation relative to the shaft with the inner bearing surface and internal rib in sliding contact with the ski pole shaft.

7. Apparatus as defined in claim 6, wherein the foil device includes top and bottom edges angled relative to the longitudinal axis of the ski pole shaft so as to be parallel to the flow of air when the ski pole shaft is held at an angle.

* * * * *

UNITED STATES PATENT AND TRADEMARK OFFICE

CERTIFICATE OF CORRECTION

PATENT NO. : 5,538,285

DATED : July 23, 1996

INVENTOR(S) : Goode

It is certified that error appears in the above-indentified patent and that said Letters Patent is hereby corrected as shown below:

Column 4, line 38, delete "Ski pole" and insert --ski pole--.

Signed and Sealed this

Seventeenth Day of December, 1996

*Attest:*

BRUCE LEHMAN

*Attesting Officer*

*Commissioner of Patents and Trademarks*